US006978778B2

(12) United States Patent
Hawkins et al.

(10) Patent No.: US 6,978,778 B2
(45) Date of Patent: Dec. 27, 2005

(54) GAS GRATE LOCATING ASSEMBLY FOR A CERAMIC-BASED COOKTOP

(75) Inventors: Dustin L. Hawkins, Cleveland, TN (US); Michael J. Shaver, Cleveland, TN (US); Jeffrey Ware, Chattanooga, TN (US)

(73) Assignee: Maytag Corporation, Newton, IA (US)

( * ) Notice: Subject to any disclaimer, the term of this patent is extended or adjusted under 35 U.S.C. 154(b) by 227 days.

(21) Appl. No.: 10/323,644

(22) Filed: Dec. 20, 2002

(65) Prior Publication Data

US 2004/0118394 A1 Jun. 24, 2004

(51) Int. Cl.[7] ..... F24C 15/10
(52) U.S. Cl. ..... 126/215; 126/214 C; 126/212
(58) Field of Search ..... 126/214 R, 214 C, 126/212, 215, 24

(56) References Cited

U.S. PATENT DOCUMENTS 3,625,196 A * 12/1971 Craver ..... 126/239
4,089,321 A * 5/1978 Ondrasik, II ..... 126/215
4,593,677 A * 6/1986 Sargunam ..... 126/214 R
4,934,333 A * 6/1990 Ducate et al. ..... 126/24
6,173,708 B1 * 1/2001 Arntz et al. ..... 126/39 R

* cited by examiner

*Primary Examiner*—Jiping Lu
(74) *Attorney, Agent, or Firm*—Diederiks & Whitelaw, PLC

(57) ABSTRACT

A cooking appliance having a ceramic-based cooktop and a plurality of gas cooking elements is provided with a grate locating assembly which includes a plurality of apertures formed at spaced locations in the cooktop, a plurality of spaced feet projecting downward from cooking vessel supporting grates, and a plurality of inserts. Each of the inserts is positioned within a respective one of the apertures in the cooktop and includes a central opening for receiving a respective grate foot in order to support the surface portion of the grate above the cooktop, while locating the feet of the grate at a position below an upper level of the cooktop.

15 Claims, 3 Drawing Sheets

GAS GRATE LOCATING ASSEMBLY FOR A CERAMIC-BASED COOKTOP

BACKGROUND OF THE INVENTION

1. Field of the Invention

The present invention pertains to the art of gas cooking appliances and, more particularly, to a method and apparatus for locating a gas grate on a ceramic-based cooktop.

2. Discussion of the Prior Art

A conventional gas cooking appliance will incorporate a cooktop which is generally formed of either coated metal or glass. The cooktop is provided with various openings for receiving gas operated burners. More specifically, each gas burner projects through the cooktop and is typically, rigidly secured to a chassis of the appliance and either fixedly or loosely secured to the cooktop. U.S. Pat. No. 6,173,708 represents one known mounting arrangement for a gas burner on a ceramic-based cooktop.

Ceramic based cooktops, e.g., ceramic and glass-ceramic cooktops, are often considered desirable because of their pleasing appearance and their ease of cleaning. Typically, a cooking apparatus with a ceramic cooktop which has at least one cooking area having an associated gas burner requires a vessel support, such as a metal grate. The vessel support must have a surface for resting a cooking vessel, and feet for raising the support above the ceramic cooktop. The cooking vessel support must be arranged so that it is directly above the gas burner and relatively fixed in position, so that the energy transfer from the burner to the cooking vessel is optimized.

One arrangement for a cooking vessel support is represented in U.S. Pat. No. 6,279,567. With such an arrangement, the ceramic cooktop has a foot holding device for maintaining a cooking vessel support in position on the cooktop. The foot holding device includes a plurality of foot holders for feet of the cooking vessel support. The foot holders are formed by grinding depressed regions out of the ceramic cooktop so that they fit the shape of the respective foot ends. In addition to other potential problems, by grinding a foot holder into the ceramic cooktop, there is a risk of scratching the cooktop with the vessel support or grate. In another embodiment, the '567 patent discloses that the foot holder may be formed of multiple parts glued to the cooktop. Since the foot holder is glued on top of the cooktop, rather than recessed within the cooktop, the vessel support of this embodiment may not be secure enough to withstand being bumped by a user.

Based on the above, there exists a need in the art for a grate locating assembly that provides a secure support for cooking vessels on a ceramic cooktop employing gas burners, while still maintaining the quality and cleanability of the cooktop.

SUMMARY OF THE INVENTION

The present invention is directed to a cooking appliance having a ceramic-based cooktop and a plurality of gas cooking elements. Each gas cooking element is provided with a grate locating assembly which includes a plurality of apertures formed at spaced locations in the cooktop. The grate locating assembly also includes a grate having a surface portion for supporting a cooking vessel and a plurality of spaced feet projecting downward from the surface portion. Further, each assembly includes a plurality of inserts, each of the inserts being positioned within a respective one of the apertures in the cooktop. Each insert includes a central opening for receiving a respective one of the feet of the grate in order to support the surface portion of the grate above the cooktop, while locating the feet of the grate at a position below an upper level of the cooktop.

In accordance with a preferred embodiment of the invention, the inserts are integrally molded of plastic. Each insert preferably includes a cylindrical portion having a sidewall, a base, an open upper end defining a respective central opening, and a peripheral flange projecting radially outwardly from the sidewall about the central opening and resting upon the cooktop. In addition, the sidewall of the insert preferably includes a serrated outer surface which abuts the cooktop within the respective aperture.

Additional objects, features and advantages of the present invention will become more readily apparent from the following detailed description of a preferred embodiment when taken in conjunction with the drawings wherein like reference numerals referring to corresponding parts in the several views.

DETAILED DESCRIPTION OF THE PREFERRED EMBODIMENT

Figure 1:
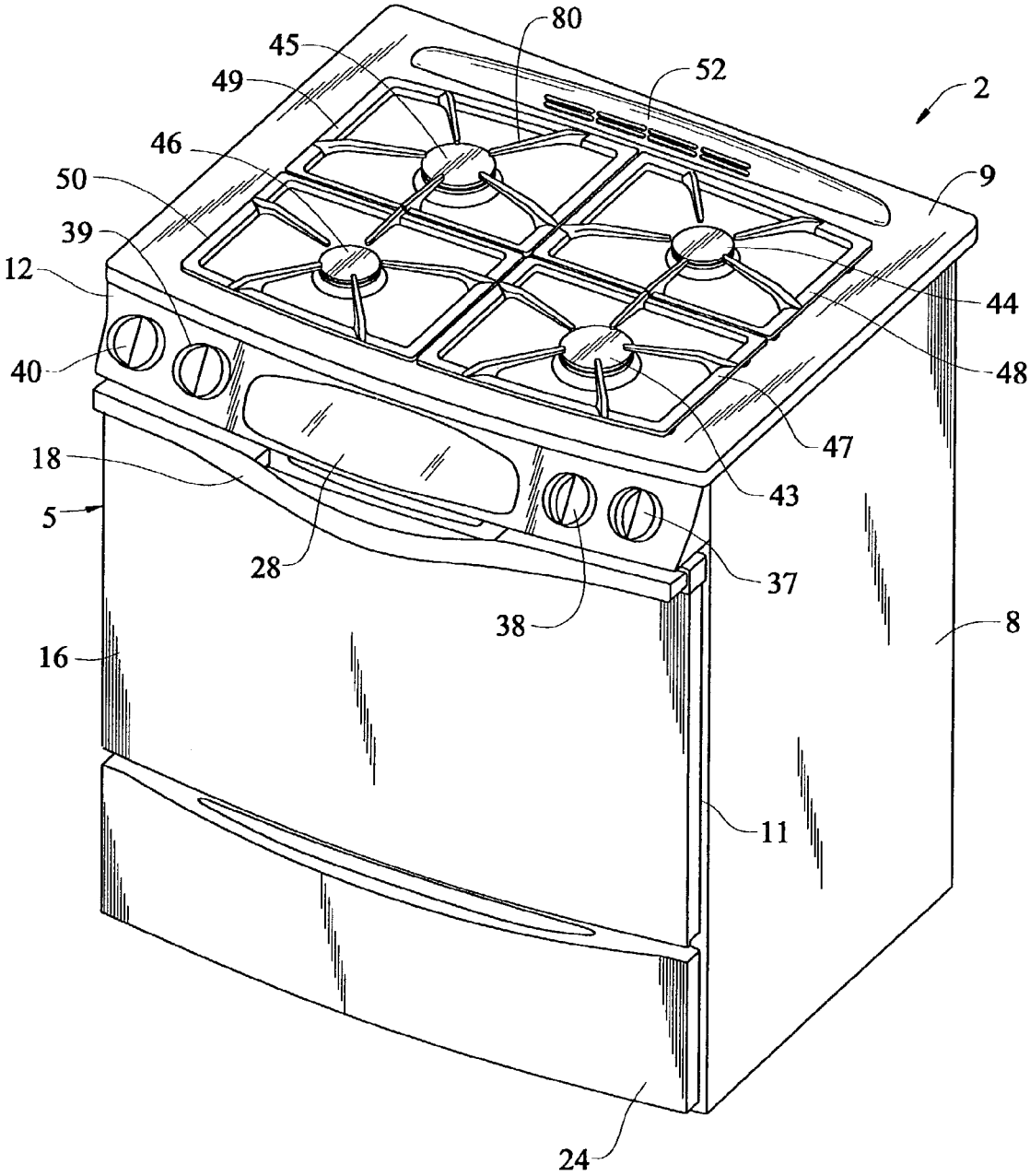
FIG. 1 is a perspective view of a cooking appliance incorporating a gas grate locating assembly constructed in accordance with a preferred embodiment of the present invention.

With initial reference to FIG. 1, the present invention is incorporated in a cooking appliance 2 which is shown as a domestic range. At this point, it should be realized that the present invention could also be used in connection with an island-type or other countertop mounted cooktop. In any event, for exemplary purposes, cooking appliance 2 is shown to include a cabinet 5 within which is formed an oven cavity (not shown). Cooking appliance 2 operates on gas and therefore a gas burner (not shown) is provided beneath a bottom of the oven cavity. Cabinet 5 includes opposing side panels 8, a cooktop 9, a rear panel (not shown) and a front panel 11. In accordance with the invention, cooktop 9 is formed of a ceramic based material. That is, cooktop 9 can take various forms and can be made from various ceramic based materials, including ceramic, glass-ceramic and like materials. An upper portion of front panel 11 defines an upper front face 12 that includes a plurality of controls as will be more fully described below. Arranged below upper front face 12 is an oven door 16 having a handle 18. In a manner known in the art, door 16 can be pivoted to access the interior oven cavity of cooking appliance 2. Also, as shown, cooking appliance 2 includes a lower drawer 24 for use in storing pans and the like.

In the embodiment illustrated, upper front face 12 is provided with a central oven control section 28 that preferably includes a display and various sets of control buttons (not shown) for establishing a plurality of potential cooking operations, times and temperatures for the oven cavity. In addition, upper front face 12 is provided with a plurality of element control knobs 37–40. Element control knobs 37–40 are used to control the operation of gas burner heating elements 43–46 respectively. Heating elements 43 and 44 are fitted with grates 47 and 48 respectively. Similarly, heating elements 45 and 46 are fitted with grates 49 and 50. Furthermore, cooktop 9 is shown to include an oven vent 52. In general, the construction and operation of cooking appliance 2, as described until this point, is known in the art such that this description has merely been provided for the sake of completeness. To this end, additional details of this construction or operation will not be provided here.

Figure 2:
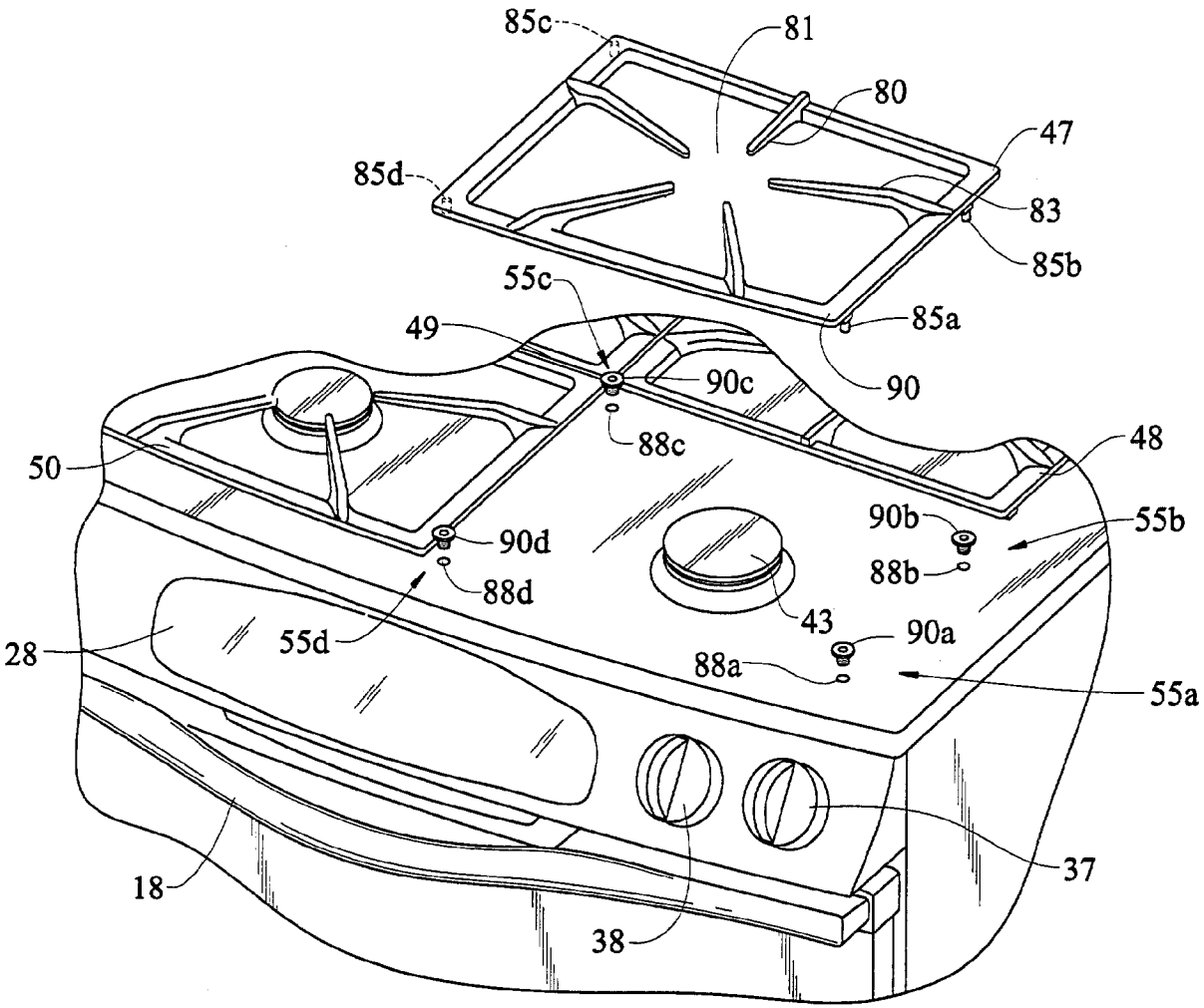
FIG. 2 is a partial exploded view of a section of the gas grate locating assembly of FIG. 1.
Figure 3:
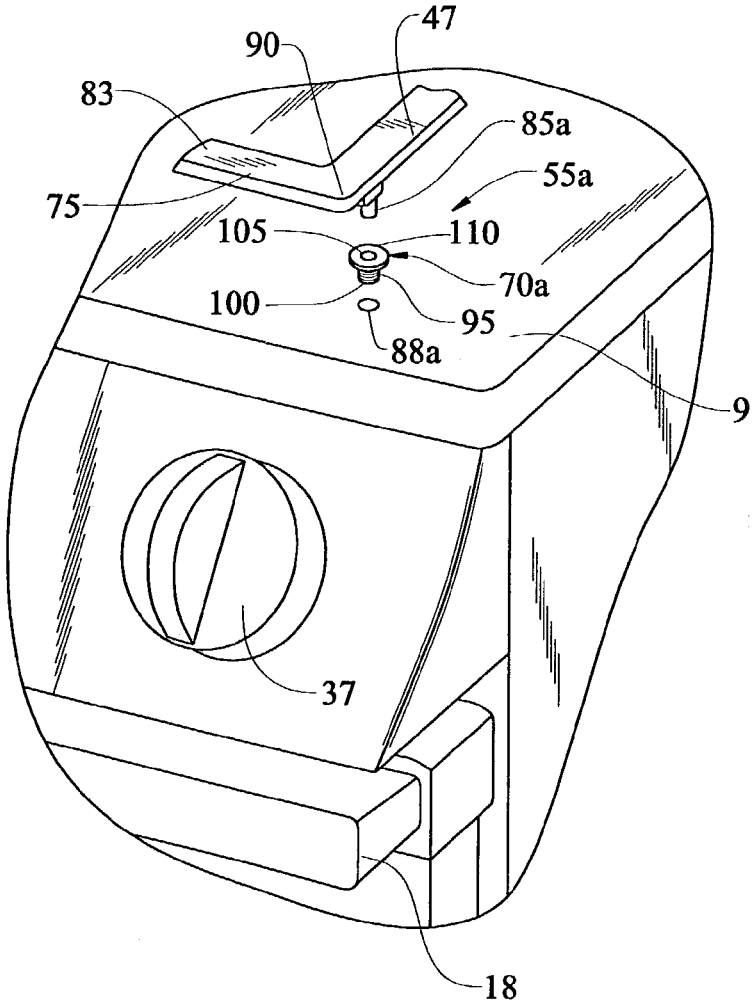
FIG. 3 is a partial exploded view of a section of the gas grate locating assembly of FIG. 1.

Referring to FIG. 2, each grate 47–50 includes a peripheral edge 75 and a plurality of projections 80 extending from edge 75 toward a center portion 81 of the respective grate 47–50. Projections 80 form surfaces for resting a cooking vessel (not shown) above a respective gas heating element 43–46. As shown, each grate 47–50 is located on cooktop 9 by a corresponding grate locating assembly 55*a*–55*d*. At this point, a detailed description of grate locating assembly 55*a* will now be made with specific reference to FIGS. 2 and 3. However, it is to be understood that grate locating assemblies 55*b*–55*d* are correspondingly constructed and arranged.

Grate locating assembly 55*a* includes a plurality of grate locating pegs or feet 85*a*–85*d* projecting beneath edge 75 at spaced peripheral locations. In addition, grate locating assembly 55*a* includes a plurality of apertures or bores, as indicated by reference numerals 88*a*–88*d*, formed within cooktop 9. Furthermore, grate locating assembly 55*a* includes a plurality of inserts 90*a*–90*d*.

With particular reference to FIG. 2, each grate foot 85*a*–85*d* of grate locating assembly 55*a* is located adjacent to a respective corner 90 of grate 47. Further, as previously mentioned, grate locating assembly 55*a* includes apertures 88*a*–88*d* for assisting in locating grate 47. A similar plurality of apertures 88*a*–88*d*, which are preferably in the order of ½ inch (1.27 cm) in diameter, are formed within cooktop 9 for each of grates 48–50. Therefore, one aperture 88*a*–88*d* exists to accommodate each grate foot 85*a*–85*d*. In any case, apertures 88*a*–88*d* are formed at positions in the cooktop 9 which align with grate feet 85*a*–85*d* when grate 47 is placed on cooktop 9. Of course, it should be realized that the number and shape of grates 47–50 can vary, along with the number and locations for grate feet 85*a*–85*d* and, correspondingly, apertures 88*a*–88*d*.

Figure 4:
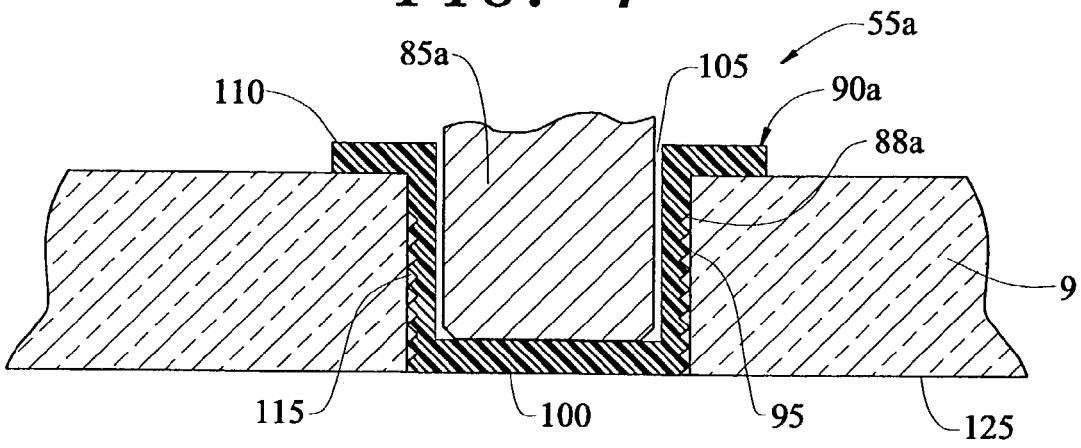
FIG. 4 is a cross-sectional view of a grate foot support arrangement employed in the gas grate locating assembly of the invention.

As also indicated above, grate locating assembly 55*a* includes inserts 90*a*–90*d* (see FIG. 2). In accordance with the most preferred form of the invention, each insert 90*a*–90*d* is integrally molded of plastic. As best shown in FIG. 4 with reference to insert 90*a*, each insert 90*a*–90*d* includes a cylindrical sidewall 95, a base 100, and an open upper end forming a central opening 105 for receiving a respective grate foot 85*a*–85*d*. Insert 90*a* also includes a peripheral flange 110 projecting radially outward from sidewall 95 about central opening 105. As shown, cylindrical sidewall 95 and base 100 fit within aperture 88*a* in cooktop 9. When sidewall 105 and base 100 of insert 90*a* are fully inserted within cooktop 9, peripheral flange 110 rests upon cooktop 9. In accordance with the most preferred form of the invention, sidewall 95 of insert 90*a* includes a serrated, deformable outer surface 115 for abutting cooktop 9 within aperture 88*a* in order to securely hold insert 90*a* within aperture 88*a* of cooktop 9. Preferably, aperture 88*a* extends entirely through cooktop 9 and, when fully inserted, base 100 of insert 90*a* is arranged substantially flush with a lower surface 125 of cooktop 9. Once each insert 90*a*–90*d* is in place, grate 47 is placed upon cooktop 9, with each of feet 85*a*–85*d* being received in central opening 105 of a respective insert 90*a*–90*d*.

With this overall arrangement, a versatile grate mounting arrangement is defined which can be employed with a variety of differently configured grates, with inserts 90*a*–90*d* extending into and preferably resting upon cooktop 9. Since each foot 85*a*–85*d* rests on base 100, each grate 47–50 is maintained out of direct engagement with cooktop 9, thereby protecting the ceramic-based material from damage and establishing a soft feel in the mounting of grates 47–50. At best, grates 47–50 could abut flanges 110 which still assures the requisite soft feel and protection for cooktop 9.

Although described with reference to a preferred embodiment of the invention, it should be readily understood that various changes and/or modifications can be made to the invention without departing from the spirit thereof. In any event, in general, the invention is only intended to be limited by the scope of the following claims.

We claim:

1. In a cooking appliance including a ceramic-based cooktop and a plurality of gas burners, a grate locating assembly comprising:

a plurality of apertures formed at spaced locations in the cooktop;

a grate including a surface portion for supporting a cooking vessel and a plurality of spaced feet projecting below the surface portion; and a plurality of inserts, each of said inserts being positioned within a respective one of the apertures in the cooktop and having a central opening receiving a respective one of the feet of the grate in order to support the surface portion of the grate above the cooktop, while locating the feet of the grate below an upper level of the cooktop, wherein each insert includes a sidewall, a base substantially closing off a lower end of the sidewall, an open upper end defining a respective said central opening, and a peripheral flange projecting radially outwardly from the sidewall about the central opening.

2. The grate locating assembly according to claim 1, wherein the inserts are integrally molded of plastic.

3. The grate locating assembly according to claim 1, wherein the sidewall of each insert constitutes a cylindrical portion.

4. The grate locating assembly according to claim 3, wherein the peripheral flange rests upon the cooktop.

5. The grate locating assembly according to claim 4, wherein the grate directly abuts the base of each insert at a position spaced below the upper level of the cooktop.

6. The grate locating assembly according to claim 5, wherein the aperture extends substantially through the cooktop, with the base being arranged substantially flush with a lower surface of the cooktop.

7. In a cooking appliance including a ceramic-based cooktop and a plurality of gas burners, a grate locating assembly comprising:

a plurality of apertures formed at spaced locations in the cooktop;

a grate including a surface portion for supporting a cooking vessel and a plurality of spaced feet projecting below the surface portion; and a plurality of inserts, each of said inserts being positioned within a respective one of the apertures in the cooktop and having a central opening receiving a respective one of the feet of the grate in order to support the surface portion of the grate above the cooktop, while locating the feet of the grate below an upper level of the cooktop, wherein each insert includes a sidewall, a base, an open upper end defining a respective said central opening, and a peripheral flange projecting radially outwardly from the sidewall about the central opening, wherein the peripheral flange rests upon the cooktop and the sidewall includes a serrated outer surface which abuts the cooktop within the aperture.

8. A method of locating a grate assembly on a ceramic based cooktop provided with a gas burner comprising:

forming a plurality of apertures in the ceramic based cooktop about the gas burner;

placing an insert, including a sidewall, a base substantially closing off a lower end of the sidewall, an open upper end defining a central opening, and a peripheral flange projecting radially outwardly from the sidewall about the central opening, in each of the plurality of apertures;

positioning a grate, having a plurality of downwardly extending feet, above the gas burner so that each foot is aligned with the central opening of a respective one of the inserts; and repositioning the grate downward towards the cooktop to position each of the plurality of feet within a respective central opening below an upper level of the cooktop.

9. The method of claim 8, further comprising: molding each of the inserts from plastic.

10. The method of claim 8, further comprising: forming each insert to include a cylindrical portion for each said sidewall.

11. The method of claim 10, further comprising: positioning the insert into a respective said aperture such that the peripheral flange rests upon the cooktop.

12. The method of claim 11, wherein the grate directly abuts the base at a position spaced below the upper level of the cooktop.

13. The method of claim 11, further comprising: extending each of the apertures substantially through the cooktop and arranging the base of each insert substantially flush with a lower surface of the cooktop.

14. A method of locating a grate assembly on a ceramic based cooktop provided with a gas burner comprising:

forming a plurality of apertures in the ceramic based cooktop about the gas burner;

placing an insert, including a sidewall, serrations on an outer surface of the sidewall, a base, an open upper end defining a central opening, and a peripheral flange projecting radially outwardly from the sidewall about the central opening, in each of the plurality of apertures, with the serrations abutting the cooktop within a respective said aperture;

positioning a grate, having a plurality of downwardly extending feet, above the gas burner so that each foot is aligned with the central opening of a respective one of the inserts; and repositioning the grate downward towards the cooktop to position each of the plurality of feet within a respective central opening below an upper level of the cooktop.

15. The method of claim 14, further comprising: positioning the insert into said aperture such that the serrations abut the cooktop within the aperture in order to securely retain the insert in place.

* * * * *